US009050838B2

(12) United States Patent
Kemma et al.

(10) Patent No.: US 9,050,838 B2
(45) Date of Patent: Jun. 9, 2015

(54) IMAGE FORMING APPARATUS WITH CARRIAGE MOUNTING RECORDING HEAD FOR EJECTING LIQUID DROPLETS

(75) Inventors: Tsuguyori Kemma, Kanagawa (JP); Makoto Kikura, Kanagawa (JP); Norikazu Yanase, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 127 days.

(21) Appl. No.: 13/448,474

(22) Filed: Apr. 17, 2012

(65) Prior Publication Data

US 2012/0293583 A1 Nov. 22, 2012

(30) Foreign Application Priority Data

May 16, 2011 (JP) ..... 2011-109894

(51) Int. Cl.

| | |
|---|---|
| ***B41J 2/165*** | (2006.01) |
| ***B41J 19/20*** | (2006.01) |
| ***B41J 29/02*** | (2006.01) |

(52) U.S. Cl.

CPC ..... *B41J 19/202* (2013.01); *B41J 29/02* (2013.01)

(58) Field of Classification Search

None

See application file for complete search history.

(56) References Cited

U.S. PATENT DOCUMENTS

| | | | | |
|---|---|---|---|---|
| 7,469,981 | B2 | 12/2008 | Katsuyama et al. | |
| 2002/0135634 | A1 * | 9/2002 | Lodal et al. | 347/37 |
| 2004/0008230 | A1 * | 1/2004 | Kelley et al. | 347/8 |
| 2007/0115321 | A1 * | 5/2007 | Yamaguchi | 347/37 |
| 2010/0328372 | A1 * | 12/2010 | Chuang | 347/8 |
| 2011/0279499 | A1 * | 11/2011 | Kemma et al. | 347/9 |
| 2012/0050407 | A1 * | 3/2012 | Sekino et al. | 347/37 |

FOREIGN PATENT DOCUMENTS

| | | |
|---|---|---|
| JP | 7-186488 | 7/1995 |
| JP | 2004-230880 | 8/2004 |
| JP | 2005-246907 | 9/2005 |

* cited by examiner

*Primary Examiner* — Alejandro Valencia

(74) *Attorney, Agent, or Firm* — Cooper & Dunham LLP

(57) ABSTRACT

An image forming apparatus includes a main body and a printing assembly. The printing assembly includes a carriage, an encoder scale, an encoder sensor, and a flexible cable. The carriage has a head mounting part and a board mounting part arranged along a direction perpendicular to the main scanning direction. The head mounting part mounts a recording head. The board mounting part mounts both the sensor and a carriage-side circuit board connected to the cable. A housing of the body has a first cover portion to cover an area opposing the head mounting part and a second cover portion to cover an area opposing the board mounting part. The first cover portion is openably disposed at the body to allow a user to open the first cover portion. The second cover portion is stationarily fixed at the body to prevent a user from opening the second cover portion.

11 Claims, 4 Drawing Sheets

IMAGE FORMING APPARATUS WITH CARRIAGE MOUNTING RECORDING HEAD FOR EJECTING LIQUID DROPLETS

CROSS-REFERENCE TO RELATED APPLICATION

This patent application is based on and claims priority pursuant to 35 U.S.C. §119 to Japanese Patent Application No. 2011-109894, filed on May 16, 2011, in the Japan Patent Office, the entire disclosure of which is hereby incorporated by reference herein.

BACKGROUND

1. Technical Field

This disclosure relates to an image forming apparatus, and more specifically to an image forming apparatus with a carriage mounting a recording head for ejecting liquid droplets.

2. Description of the Related Art

Image forming apparatuses are used as printers, facsimile machines, copiers, plotters, or multi-functional devices having two or more of the foregoing capabilities. As one type of image forming apparatus employing a liquid-ejection recording method, an inkjet recording apparatus is known that uses a recording head (liquid ejection head or liquid-droplet ejection head) for ejecting droplets of ink.

Such inkjet-type image forming apparatuses fall into two main types: a serial-type image forming apparatus that forms an image by ejecting droplets from the recording head while moving a carriage mounting the recording head in a main scanning direction, and a line-head-type image forming apparatus that forms an image by ejecting droplets from a linear-shaped recording head held stationary in the image forming apparatus. The serial-type image forming apparatus may have a linear encoder including an encoder scale and an encoder sensor to detect the position (main scanning position) of the carriage in a main scanning direction. The encoder scale is disposed along the main scanning direction and the encoder sensor is mounted on the carriage.

The carriage may mount a carriage-side circuit board, e.g., a relay board to relay between a driving circuit for driving the recording head and a main-body-side control circuit board disposed at a main body of the apparatus and mounting a control circuit for controlling the entire apparatus. The main-body-side control circuit board and the carriage-side circuit board are connected via a flexible cable, e.g., a flexible flat cable (FFC), and the carriage-side circuit board and the recording head are connected via a flexible printed circuit (FPC) including a driving circuit or other type of flexible flat cable.

For the image forming apparatus, an openable top cover may be disposed above the carriage so that, for example, when a paper jam occurs inside, a user can access to the interior of the apparatus to remove a jammed sheet.

However, in such a case where the user can access to the interior of the apparatus, the user is likely to contact the encoder scale or flexible cable, thus causing faulty reading of the encoder or damage to the flexible cable.

BRIEF SUMMARY

In an aspect of this disclosure, there is provided an image forming apparatus including a main body and a printing assembly. The main body has a housing. The printing assembly is disposed in the main body. The printing assembly includes a carriage, an encoder scale, an encoder sensor, and a flexible cable. The carriage is movable in a main scanning direction and mounts a recording head to eject droplets. The encoder scale is disposed along the main scanning direction. The encoder sensor is mounted on the carriage to read the encoder scale. The flexible cable supplies signals from the main body to the carriage. The carriage has a head mounting part and a board mounting part that are arranged along a direction perpendicular to the main scanning direction. The head mounting part mounts the recording head. The board mounting part mounts both the encoder sensor and a carriage-side circuit board connected to the flexible cable. The housing has a first cover portion to cover an area opposing the head mounting part and a second cover portion to cover an area opposing the board mounting part. The first cover portion is openably disposed at the main body to allow a user to open the first cover portion. The second cover portion is stationarily fixed at the main body to prevent a user from opening the second cover portion.

In an aspect of this disclosure, there is provided an image forming apparatus including a main body and a printing assembly. The main body has a housing. The printing assembly is disposed in the main body. The printing assembly includes a carriage, an encoder scale, an encoder sensor, and a flexible cable. The carriage is movable in a main scanning direction and mounts a recording head to eject droplets. The encoder scale is disposed along the main scanning direction. The encoder sensor is mounted on the carriage to read the encoder scale. The flexible cable supplies signals from the main body to the carriage. The carriage has a head mounting part and a board mounting part that are arranged along a direction perpendicular to the main scanning direction. The head mounting part mounts the recording head. The board mounting part mounts both the encoder sensor and a carriage-side circuit board connected to the flexible cable. The housing has a first cover portion to cover an area opposing the head mounting part and a second cover portion to cover an area opposing both the board mounting part and the encoder scale. The first cover portion is openably disposed at the main body to allow a user to open the first cover portion. The second cover portion is disposed at a position closer to a front end of the main body than the first cover portion and stationarily fixed at the main body to prevent a user from opening the second cover portion.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
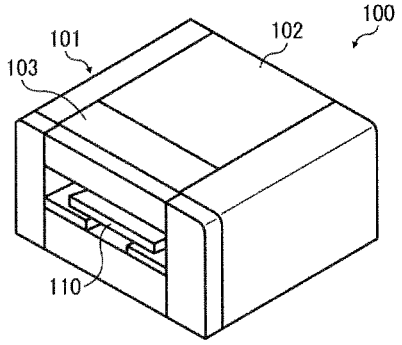
FIG. 1 is an external perspective view of an image forming apparatus according to an exemplary embodiment of the present disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

In this disclosure, the term "sheet" used herein is not limited to a sheet of paper but be, e.g., an OHP (overhead projector) sheet, a cloth sheet, a grass sheet, a substrate, or anything on which droplets of ink or other liquid can be adhered. In other words, the term "sheet" is used as a generic term including a recording medium, a recorded medium, a recording sheet, or a recording sheet of paper. The term "image forming apparatus" refers to an apparatus that ejects ink or any other liquid onto a medium to form images on the medium. The medium is made of, for example, paper, string, fiber, cloth, leather, metal, plastic, glass, timber, and ceramic. The term "image formation", which is used herein as a synonym for "recording" or "printing", includes providing not only meaningful images, such as characters and figures, but meaningless images, such as patterns, to the medium (in other words, the term "image formation" includes only causing liquid droplets to land on the medium).

The term "ink" as used herein is not limited to "ink" in a narrow sense unless specifically distinguished and includes any types of liquid usable for image formation, such as recording liquid, fixing solution, DNA sample, resist, pattern material, and resin.

The term "image" used herein is not limited to a two-dimensional image and includes, for example, an image applied to a three dimensional object and a three dimensional object itself formed as a three-dimensionally molded image.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

First, an image forming apparatus according to an exemplary embodiment of the present disclosure is described with reference to FIGS. 1 to 5.

Figure 2:
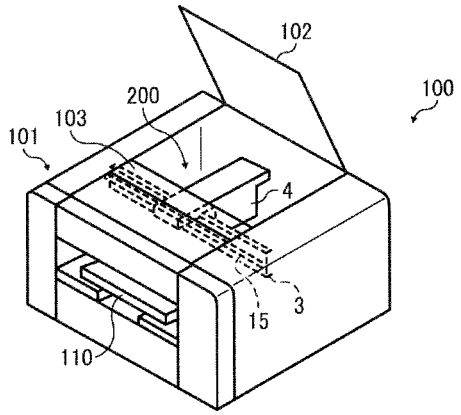
FIG. 2 is a perspective view of the image forming apparatus illustrated in FIG. 1 with an openable cover opened.
Figure 3:
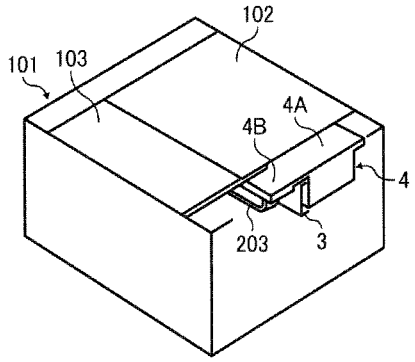
FIG. 3 is a schematic perspective view of the image forming apparatus illustrated in FIG. 1 with the openable cover closed.
Figure 4:
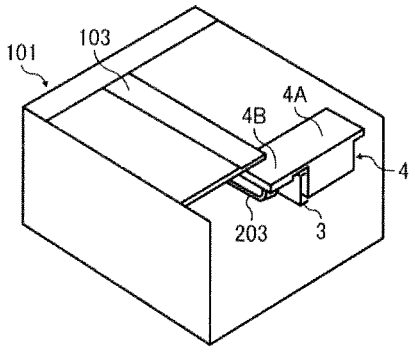
FIG. 4 is a schematic perspective view of the image forming apparatus illustrated in FIG. 1 from which the openable cover is removed.
Figure 5:
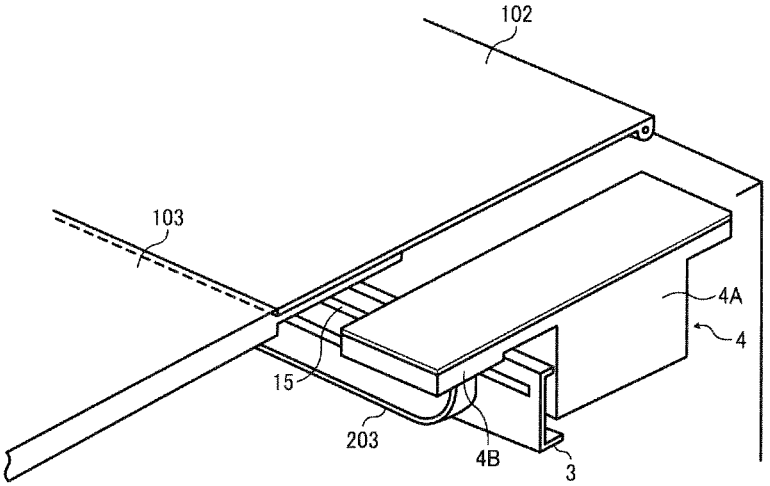
FIG. 5 is a partially enlarged perspective view of the image forming apparatus illustrated in FIG. 3.

FIG. 1 is an external perspective view of the image forming apparatus. FIG. 2 is a perspective view of the image forming apparatus with an openable cover opened. FIG. 3 is a schematic perspective view of the image forming apparatus with the openable cover closed. FIG. 4 is a schematic perspective view of the image forming apparatus from which the openable cover is removed. FIG. 5 is a partially enlarged perspective view of the image forming apparatus.

The image forming apparatus is a serial-type image forming apparatus and has a printing assembly 200 in a housing 101 of an apparatus main body 100. The housing 101 has an openable cover 102 serving as a first cover portion at a part of its upper face. By opening the openable cover 102, a user can access to the printing assembly 200 in the apparatus. The housing 101 also has a stationary cover 103 serving as a second cover portion which a user cannot open.

Next, the printing assembly 200 is described with reference to FIGS. 6 and 7.

Figure 6:
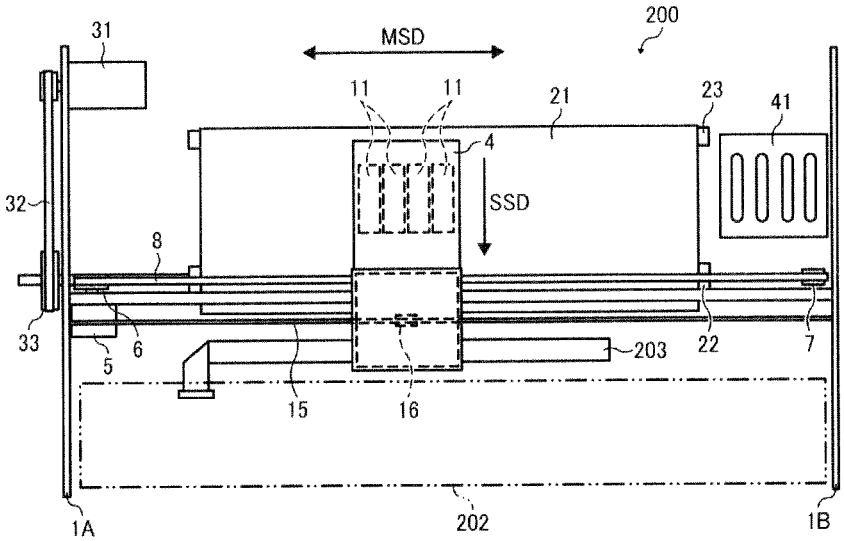
FIG. 6 is a plan view of a printing assembly of the image forming apparatus.

FIG. 6 is a plan view of the printing assembly 200. FIG. 7 is a side view of the printing assembly 200.

The printing assembly 200 includes a main left-side plate 1A, a main right-side plate 1B, a guide member 3, a carriage 4, a main scanning motor 5, a driving pulley 6, a driven pulley 7, and a timing belt 8. The guide member 3 extends between the main side plates 1A and 1B to support the carriage 4. The carriage 4 supported on the guide member 3 is slidable in a main scanning direction (indicated by an arrow MSD in FIG. 6). The carriage 4 is moved for scanning in the main scanning direction by the main scanning motor 5 via the timing belt 8 extending between the driving pulley 6 and the driven pulley 7.

The carriage 4 mounts recording head units 11 and head tanks. The recording head units 11 (hereinafter simply referred to as "recording heads 11") are liquid ejection heads serving as image forming devices to eject ink droplets of different colors, for example, yellow (Y), cyan (C), magenta (M), and black (K). The head tanks supply ink to the liquid ejection heads. The recording heads 11 are mounted on the carriage 4 so that multiple nozzle rows each including a plurality of nozzles are arranged parallel to a sub scanning direction (indicated by an arrow SSD in FIG. 6) perpendicular to the main scanning direction and ink droplets are ejected downward from the nozzles.

An encoder scale 15 is disposed along the main scanning direction of the carriage 4. On the carriage 4 is mounted an encoder sensor 16 serving as a transmissive photosensor to read a scale (scale index serving as position identifier) of the encoder scale 15. The encoder scale 15 and the encoder sensor 16 form a linear encoder serving as a position detector to detect the position and speed of the carriage 4.

Figure 7:
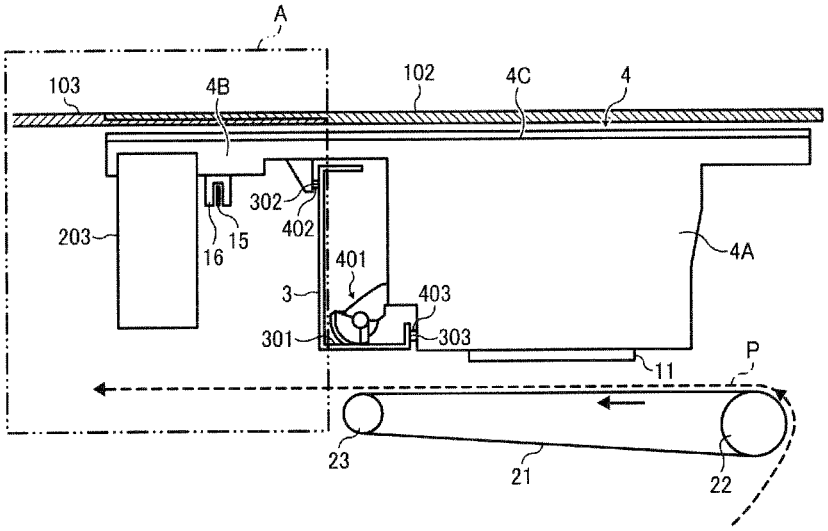
FIG. 7 is a side view of the printing assembly illustrated in FIG. 7.

The guide member 3 is, e.g., a sheet metal and has guide faces 301, 302, and 303 serving as support faces to slidably guide the carriage 4 (see FIG. 7). The carriage 4 has a slide portion 401 slidably supported by the guide face 301 of the guide member 3, a slide portion 402 slidably contacting the guide face 302, and a slide portion 403 slidably contacting the guide face 303 (see FIG. 7). In such a case, the guide face 301 of the guide member 3 serves as a height positioning face to define the position of the carriage 4 in the height direction and a receiving face (rotation stopping portion) to receive the moment of the carriage 4 by its weight, and a sub-scanning positioning face to define the position of the carriage 4 in the sub-scanning direction.

Below the carriage 4 is disposed a conveyance belt 21 serving as a conveyance unit to convey a sheet P (see FIG. 7) in the sub scanning direction. The conveyance belt 21 is an endless belt looped around a conveyance roller 22 and a tension roller 23. The conveyance roller 22 is rotated by a sub-scanning motor 31 via a timing belt 32 and a timing pulley 33. The rotation of the conveyance roller 22 causes the conveyance belt 21 to circulate in the sub-scanning direction (indicated by the arrow SSD in FIG. 7).

At one end in the main scanning direction (indicated by the arrow MSD in FIG. 7) of the carriage 4, a maintenance unit 41 is disposed near one lateral side of the conveyance belt 21 to maintain and recover nozzle conditions of the recording heads 11. The maintenance unit 41 includes, for example, cap members, a wiping member, and a second liquid receptacle. The cap members cap nozzle faces (i.e., faces in which nozzle are formed) of the recording heads 11. The wiping member wipes the nozzle faces of the liquid ejection heads. The second liquid receptacle receives droplets ejected for maintenance, not for image formation.

As illustrated in FIG. 1, the image forming apparatus further includes a sheet feed-and-output tray 110 removably mounted in the apparatus main body 100. The sheet feed-and-output tray 110 serves as, e.g., both a sheet feeding unit to feed a sheet to the conveyance belt 21 and a sheet output unit to output a sheet having an image formed with ink droplets ejected from the recording heads 11.

While moving the carriage 4 in the main scanning direction, the image forming apparatus drives the recording heads 11 in accordance with image signals to eject ink droplets onto the sheet conveyed intermittently by the conveyance belt 21. After a first band of an image is recorded on the sheet, the sheet is conveyed at a certain distance by the conveyance belt 21. Then, another band of the image is recorded on the sheet and the sheet is conveyed at the certain distance. Such operation is repeated to form the full image and then the sheet with the image is outputted to the sheet feed-and-output tray 110.

Next, a carriage part is described with reference to FIG. 8.

Figure 8:
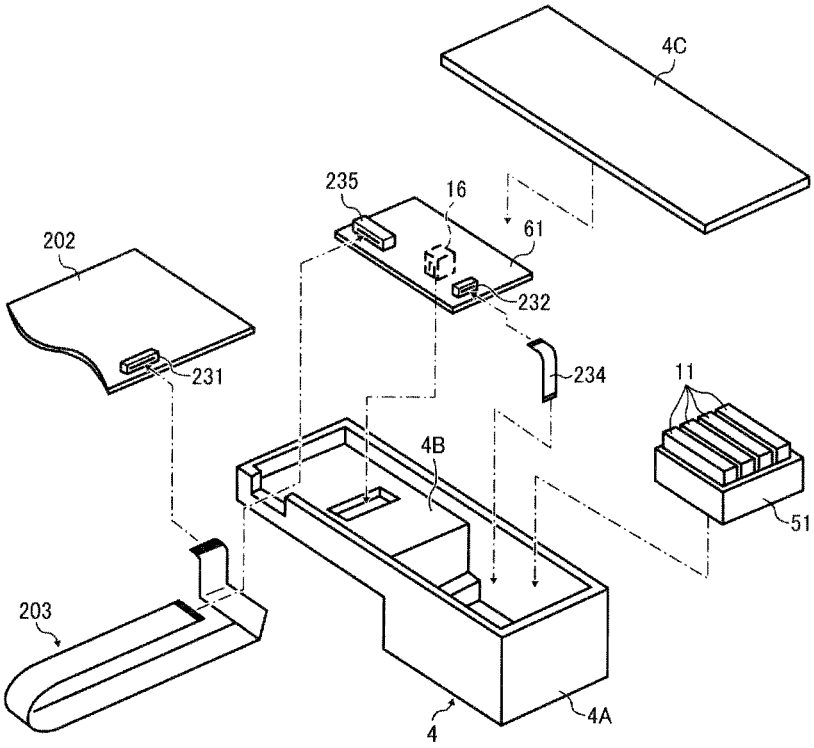
FIG. 8 is an exploded perspective view of a carriage of the image forming apparatus.

FIG. 8 is an exploded perspective view of a carriage part of the image forming apparatus.

The carriage 4 has a head mounting part 4A to mount the recording heads 11 and a board mounting part 4B to mount a carriage-side circuit board 61 having circuits. The head mounting part 4A and the board mounting part 4B are arranged along a direction in which the sheet is fed (sub-scanning direction). The carriage has a carriage cover 4C to cover an upper area of both the head mounting part 4A and the board mounting part 4B.

In the head mounting part 4A is mounted a head holder 51 holding the recording heads 11.

The carriage-side circuit board 61 serves as a relay board to relay data transmission between a main-body-side control circuit board 202 at the apparatus main body 100 and each of a driver circuit (driver IC) for driving the recording heads 11, the encoder sensor 16, and other sensors mounted on the carriage 4. The main-body-side control circuit board 202 mounts control circuits to control, e.g., the conveyance operation and driving of the conveyance belt 21 and other components or the maintenance operation of the maintenance unit 41.

A flexible flat cable (FFC) 203 connects the carriage-side circuit board 61 to the main-body-side control circuit board 202 via connectors 231 and 235. The carriage circuit board 61 is connected to the respective recording heads 11 via a FFC 234, a connector 232, and other connectors.

In above-described configuration of the image forming apparatus according to this exemplary embodiment, as illustrated in FIG. 7, the encoder scale 15 is disposed below the board mounting part 4B of the carriage 4. As illustrated in FIGS. 6 and 7, the FFC 203 is disposed below the board mounting part 4B of the carriage 4 so as to be movable along the main scanning direction, is bent upward from below the carriage-side circuit board 61, and is connected to the carriage-side circuit board 61 from the main scanning direction.

The guide member 3 serves as a guide unit to guide the carriage 4 along the main scanning direction and is disposed at a position lower than the board mounting part 4B and between the head mounting part 4A and the encoder sensor 16. The guide member 3 has a wall face that opposes the encoder sensor 16 and the FFC 203 in an entire movable range of the carriage 4.

Here, where a side of the apparatus main body proximal to the head mounting part 4A of the carriage 4 is referred to as the "rear side" of the apparatus main body and the opposite side proximal to the board mounting part 4B is referred to as the "front side" of the apparatus main body, as illustrated in FIG. 1, the stationary cover 103 serving as the second cover portion is disposed at the front side of the upper face of the apparatus main body. The guide member 3 serving as the guide unit is disposed at a position closer to the rear side of the apparatus main body than the encoder sensor 16 and the FFC 203.

Next, an area to which a user can access in the image forming apparatus is described below.

As illustrated in FIG. 7, the openable cover 102 of the housing 101 is disposed above the head mounting part 4A of the carriage 4 to cover an area opposing the head mounting part 4A. The stationary cover 103 is disposed above the board mounting part 4B of the carriage 4 to cover an area opposing the board mounting part 4B.

For such a configuration, if a paper jam occurs, as illustrated in FIG. 2, by opening the openable cover 102, a user can access to a movement area of the head mounting part 4A in the printing assembly 200 to remove a jammed sheet remaining between the conveyance belt 21 and the head mounting part 4A of the carriage 4.

At this time, an upper side of the movement area of the board mounting part 4B is covered with the stationary cover 103. As a result, the user cannot access to, e.g., an area A demarcated by a chain double-dashed line in FIG. 7, thus preventing the user from contacting the encoder scale 15 and the FFC 203.

As described above, the carriage has the head mounting part to mount recording heads and the board mounting part to mount the carriage-side circuit board with at least the encoder sensor. The head mounting part and the board mounting part are arranged along a direction perpendicular to the main scanning direction. The housing of the apparatus main body has the openable cover to cover an area opposing the head mounting part and the stationary cover to cover an area opposing the board mounting part. The openable cover is mounted on the main body so that a user can open it. The stationary cover is fixed on the main body so that a user cannot open it. Such a configuration prevents the user from contacting the encoder scale and the flexible cable.

The stationary cover 103 is fixed with an engagement structure, e.g., screws or resin hooks to allow a service person to remove the stationary cover 103 to perform, for example, replacement of the carriage 4, cleaning and replacement of the encoder scale 15, and/or replacement of the FFC 203.

In such a case, for example, fixing the stationary cover 103 with screws allows a service person to more easily remove the stationary cover 103, or fixing the stationary cover 103 with engagement of resin hooks can reduce the number of components and cost.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a main body having a housing;

a printing assembly disposed in the main body;

the printing assembly including a carriage movable in a main scanning direction and mounting a recording head to eject droplets, the carriage including a head mounting part and a board mounting part that are arranged along a direction perpendicular to the main scanning direction, an encoder scale disposed along the main scanning direction, an encoder sensor mounted on the carriage to read the encoder scale, a guide member to guide the carriage along the main scanning direction, a carriage-side circuit board, and a flexible cable connected to the carriage-side circuit board to supply signals from the main body to the carriage-side circuit board, wherein the recording head is mounted on the head mounting part, and both the encoder sensor and the carriage-side circuit board connected to the flexible cable are mounted on the board mounting part, and the guide member is interposed between (i) the recording head on the head mounting part and (ii) the encoder scale and the encoder sensor on the board mounting part, in the direction perpendicular to the main scanning direction, wherein the housing has a first cover portion to cover an area opposing the head mounting part and a second cover portion to cover an area opposing the board mounting part, the first cover portion is openably disposed at the main body to allow a user to open the first cover portion to an open position, the second cover portion is stationarily fixed at the main body to prevent a user from opening the second cover portion, and the first cover portion and second cover portion collectively form an upper face of the housing and are arranged side-by-side in the direction perpendicular to the main scanning direction, and wherein the encoder scale is disposed in an area opposing and below the stationarily fixed second cover portion and is not disposed within an opening area of the housing which the first cover portion covers at a closed position.

2. The image forming apparatus of claim 1, wherein the encoder scale is disposed below the board mounting part of the carriage, and the flexible cable is disposed below the board mounting part so as to be movable along the main scanning direction, is bent upward from below the carriage-side circuit board, and is connected to the carriage-side circuit board from the main scanning direction.

3. The image forming apparatus of claim 2, wherein the guide member is disposed below the board mounting part and between the head mounting part and the encoder sensor, and the guide member has a wall face that opposes the encoder sensor and the flexible cable in an entire movable range of the carriage.

4. The image forming apparatus of claim 3, wherein the board mounting part of the carriage is disposed at a front side of the main body, the head mounting part of the carriage is disposed at a rear side of the main body, the second cover portion is disposed at an upper face of the front side of the main body, and the guide member is disposed at a position closer to the rear side of the main body than the encoder sensor and the flexible cable.

5. The image forming apparatus of claim 1, wherein the guide member has a wall face perpendicular to and below the board mounting part and opposes the stationary cover portion.

6. The image forming apparatus of claim 1, wherein the flexible cable and the encoder sensor are disposed right below the stationary cover portion.

7. The image forming apparatus of claim 1, further comprising a carriage cover member to cover the head mounting part and the board mounting part.

8. The image forming apparatus of claim 1, wherein the board mounting part has an opening in an area of a face of the carriage on which the carriage-side circuit board is mounted, and the encoder sensor is attached to the carriage-side circuit board and extends through the opening.

9. The image forming apparatus of claim 1, wherein the second cover portion opposes one surface of the board mounting part, and the encoder scale is disposed to oppose an opposite surface, opposite to said one surface, of the board mounting part.

10. The image forming apparatus of claim 1, wherein the first cover portion of the housing is disposed above the head mounting part to cover the area opposing the head mounting part and the second cover portion is disposed above the board mounting part to cover the area opposing the board mounting part.

11. The image forming apparatus of claim 1, wherein the head mounting part includes a first floor portion constituting a bottom of a cavity to accommodate the recording head, and the board mounting part includes a second floor portion on which the encoder sensor and the carriage-side circuit board are mounted, and the encoder sensor is mounted on the carriage-side circuit board, and the carriage-side circuit board is disposed on the second floor portion of the carriage in a state in which a first face of the carriage-side circuit board opposite a second face of the carriage-side circuit board on which the encoder sensor is mounted opposes the second cover portion, and a distance in a height direction between the first cover portion and the first floor portion is greater than a distance in the height direction between the second cover portion and the second floor portion.

* * * * *